US009028176B1

(12) United States Patent
Malloy

(10) Patent No.: US 9,028,176 B1
(45) Date of Patent: May 12, 2015

(54) GUARD FOR FOLDABLE SHORING

(71) Applicant: Tom Malloy Corporation, Los Angeles, CA (US)

(72) Inventor: Kevin T. Malloy, Los Angeles, CA (US)

(73) Assignee: Tom Malloy, Los Angeles, CA (US)

( * ) Notice: Subject to any disclaimer, the term of this patent is extended or adjusted under 35 U.S.C. 154(b) by 0 days.

(21) Appl. No.: 14/281,523

(22) Filed: May 19, 2014

(51) Int. Cl.
*E02D 17/08* (2006.01)

(52) U.S. Cl.
CPC ..... *E02D 17/08* (2013.01)

(58) Field of Classification Search
CPC ..... E02D 17/04; E02D 17/08; E02D 17/083
See application file for complete search history.

(56) References Cited

U.S. PATENT DOCUMENTS 3,335,573 A * 8/1967 Ward ..... 405/282
4,453,863 A * 6/1984 Sutton et al. ..... 405/282
4,669,704 A * 6/1987 Abraham et al. ..... 254/100
5,080,533 A * 1/1992 Cooper ..... 405/282
5,232,313 A * 8/1993 Jennings et al. ..... 405/283
7,101,119 B2 9/2006 Cerda
2006/0024137 A1 * 2/2006 Cerda ..... 405/282

* cited by examiner

*Primary Examiner* — Benjamin Fiorello
(74) *Attorney, Agent, or Firm* — Fulwider Patton LLP

(57) ABSTRACT

A finger guard is described, removably attachable to a shoring device of the type having a pair of opposed shoring columns having outer and inner surfaces, the outer surfaces exposed for contact with excavation surfaces and with an extendable and retractable jack pivotally secured at the inner surfaces to the column. The finger guard comprises a sheet of stiff material; at least one connector attached to the sheet, wherein the at least one connector includes: two arms spaced apart from each other and extending generally parallel to each other; a shoulder element extending between the two arms, and connecting the two arms together; a leg element, extending from the shoulder element parallel with the arms; wherein, the sheet of stiff material is attached to the at least one connector; a set screw threadably passing through one of the arms, the set screw being configured to attach the connector to a portion of a shoring column.

10 Claims, 7 Drawing Sheets

GUARD FOR FOLDABLE SHORING

BACKGROUND

The present invention relates to a safety device in the construction industry. Specifically, the invention relates to a safety guard attachable to shoring devices to protect the hands and fingers of workmen from being pinched or caught in a shoring device when it is being assembled, folded or collapsed.

Sound excavation safety practice and OSHA standards for safe trenching require that the side walls of trenches be supported or shored against collapse. The particular shoring requirements vary considerably with soil composition and trench size. With reference to FIG. 1, FIG. 2A and FIG. 2B, generally when excavating a trench 10 in stable soils, state and federal regulations require the trenches having a depth greater than approximately four to five feet be vertically shored to avoid exposing workers to the hazards of unshored trenches. Shoring devices 11 generally utilize vertical support members or shoring columns 12 which are held in place against the opposite trench walls by extendable hydraulic booms or jacks 14.

Generally known devices include opposite trench-engaging columns 12 which are connected to hydraulic jacks 14 at blocks 20 pivotally secured to shoring columns 12. In setting up such devices, the artisan lowers the shoring device into the trench causing it to unfold. The hydraulic jacks 14 are pressurized, usually using a portable source of hydraulic pressure such as a hand pump which feed into a nozzle 18 operably connected with the hydraulic jack 14. The opposite shoring columns 12 directly engage the side walls 16, or are attached to panels (not shown in FIG. 1) which support the excavation.

When it is desired to remove the shoring device, hydraulic pressure is relieved and the shoring device is pulled from the trench using a suitable tool or rope. The shoring device may then be collapsed or folded to a position with the shoring column 12 assuming a position adjacent one another. Collapsibility is permitted by the pivotal attachment of the opposite ends of the jacks 14 to mounting blocks 20 on the shoring columns.

A particular safety problem is that the mounting blocks 20 are usually located between flanges 22 extending from the shoring columns 12. When the shoring device is collapsed, the mounting block 20 pivots around a pin 21 (see for example FIGS. 4 and 6) and the worker, in lifting or grasping the shore, may inadvertently cause a finger to be pinched between the block 20 and the column 12 due to the scissor action of the components.

In order to protect workers, some shoring devices, known in the art, are equipped with a finger guard 24 (see for example FIG. 2B) which is screwed onto or pinned onto the shoring columns 12 to hold them in place using a screw or pin 26. However, such finger guards, while providing some degree of protection are not easily attached to or removed from existing shoring devices. Moreover, the holes permitting attachment to the shoring columns has the effect of weakening the columns which experience a considerable bending moment from the action of the hydraulic jacks. Furthermore, the system of attachment requiring holes to be formed in the shoring column leaves the artisan with little flexibility in locating his finger guard along the length of the column. The guards of confined to one location, determined by the position of the respective hole. And yet further, a shoring guard 24 of the kind seen in FIG. 2B is limited to the particular type of shoring column to which it is designed to be attached. This may give rise to the unwelcome experience in which an excavation contractor discovers that he has one type of shoring column, but different types of finger guards. What is needed in this regard is a universally applicable shoring guard that can be moved from one type of shoring column to another, allowing maximum economy and versatility.

Accordingly, it is a primary object of the present invention to provide an improved finger guard device for shoring devices which is safe, simple and easily attachable to a shoring device, and does not interfere with the structural integrity of the shoring device, and allows flexibility in locating the guard both along the length of the shoring device, and to other shoring devices of a different type.

SUMMARY OF THE INVENTION

A safety guard is described herein that has advantages over the prior art in the field of trench excavations, and shoring of those trenches. In one embodiment, the safety guard is a finger guard that is removably attachable to a shoring device of the type having a pair of opposed shoring columns having outer and inner surfaces, the outer surfaces exposed for contact with excavation surfaces and with an extendable and retractable jack pivotally secured at the inner surfaces to the column. In some embodiments, the finger guard comprises a sheet of stiff material and at least one connector attached to the sheet. The at least one connector includes two arms spaced apart from each other and extending generally parallel to each other. A shoulder element extends between the two arms, and connects the two arms together. A leg element is provided to extend from the shoulder element parallel with the arms. The sheet of stiff material is attached to the at least one connector. A set screw threadably passes through one of the arms, the set screw being configured to attach the connector to the flange of the shoring column. In some embodiments, the sheet of still material is made from PVC. In further embodiments, the at least one connector is made from aluminum, preferably extruded aluminum. The two arms are preferably spaced apart from each other by an distance in the range of 15 mm to 25 mm.

In another facet, the invention is a method for protecting an artisan's hand during soil excavation proceedings while using a shoring device of the type having a pair of opposed shoring columns having outer and inner surfaces, the outer surfaces exposed for contact with excavation surfaces and with an extendable and retractable jack pivotally secured at the inner surfaces to the column, wherein the inner surface includes at least one flange. The method comprises attaching, to a stiff sheet of material, two connectors. Each connector has a forked configuration with two parallel arms that are set apart from each other. Each arm is positioned on either side of the flange. The connectors are attached to the flange by advancing a rotatable set screw inserted through an arm of each connector respectively. In some embodiments, the connectors are un-attached from the flange by retracting the rotatable set screw, followed by adjusting the position of the connectors on the flange, followed by re-attaching the connectors to the flange by advancing the set screw.

Thus, the present invention provides a new and useful system and method for a safety feature during soil excavation and shoring. These advantages will be better understood when read in conjunction with the figures and the detailed description of the embodiments.

DETAILED DESCRIPTION OF THE EMBODIMENTS

A safety guard having features of the invention is described herein in conjunction with the figures. In one embodiment, the invention is a finger guard 50 that comprises a stiff sheet 51 of material that is generally planar. The stiff sheet 51 may be fabricated from any durable material capable of withstanding the rough environment of a building site, preferably Poly Vinyl Chloride (PVC), or other suitable polymer that is water proof and will not degrade when wet or damp, and which is easy to cut and shape, yet which will not deform upon the imposition of reasonably heavy forces. The thickness of the stiff sheet is preferably about 3 mm, and may be given an outline shape that is suitable for blocking the hand of an artisan from advancing into a position that might become entrapped by a scissor movement between a shoring column and a hydraulic jack.

Figure 5:
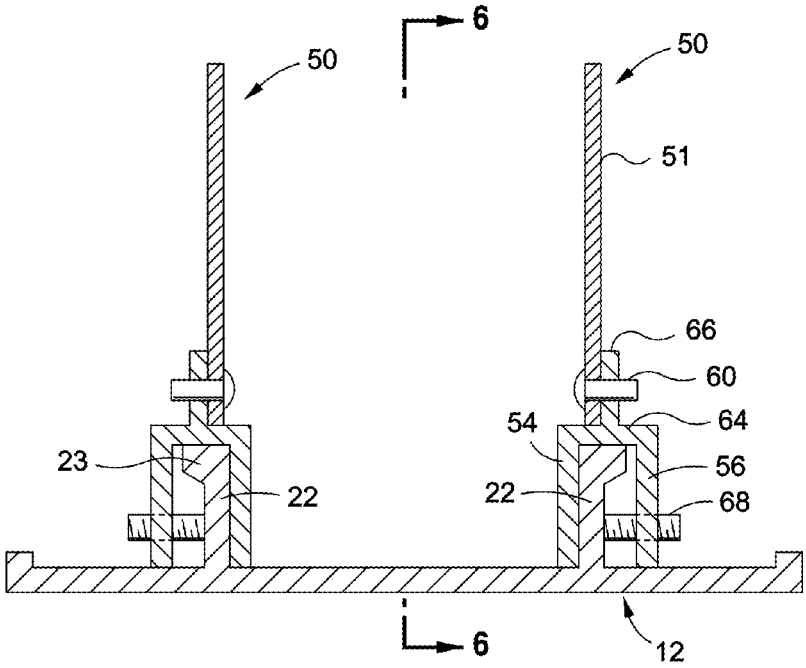
FIG. 5 is a sectional view taken through the invention when attached to a shoring column.

Along one edge of the stiff material 51, two connectors 52 are affixed, preferably by set screw or rivet 60. FIGS. 3, 5, 6 and 7. In one embodiment, the two connectors have a generally fork shaped configuration, which includes two vertically extending tines or arms 54, 56, set apart from each other and extending parallel to each other. The arms are spaced apart from each other sufficiently to receive a flange 22 of a shoring column 12. In some instances, a flange 22 of the shoring column may include a tip flange 23 (as seen in FIG. 5), and the two arms must be sufficiently spaced apart to also receive the tip flange 23. In practice, a preferred distance of separation between the arms is between 15 mm and 25 mm, and this has been found to fit over practically all known shoring columns that are presently on the market. The depth of the arm is preferably in the range of 25 mm to 40 mm, and this has been found to fit adequately over the tip flange 23 of most shoring columns presently on the market.

Each arm is connected to a horizontally extending shoulder 64. Extending vertically upwards from the center of the shoulder, and parallel with the arms, is a leg 66 which carries the rivet 60 for connection to the stiff sheet. One of the arms carries a further set screw 68. In some embodiments, the set screw may be fitted with a jamb nut 74 (FIG. 7) to secure the set screw in position once it has been advanced to the desired depth. Preferably, the connector 52 is formed from aluminum, and particularly preferred is extruded aluminum.

Figure 1:
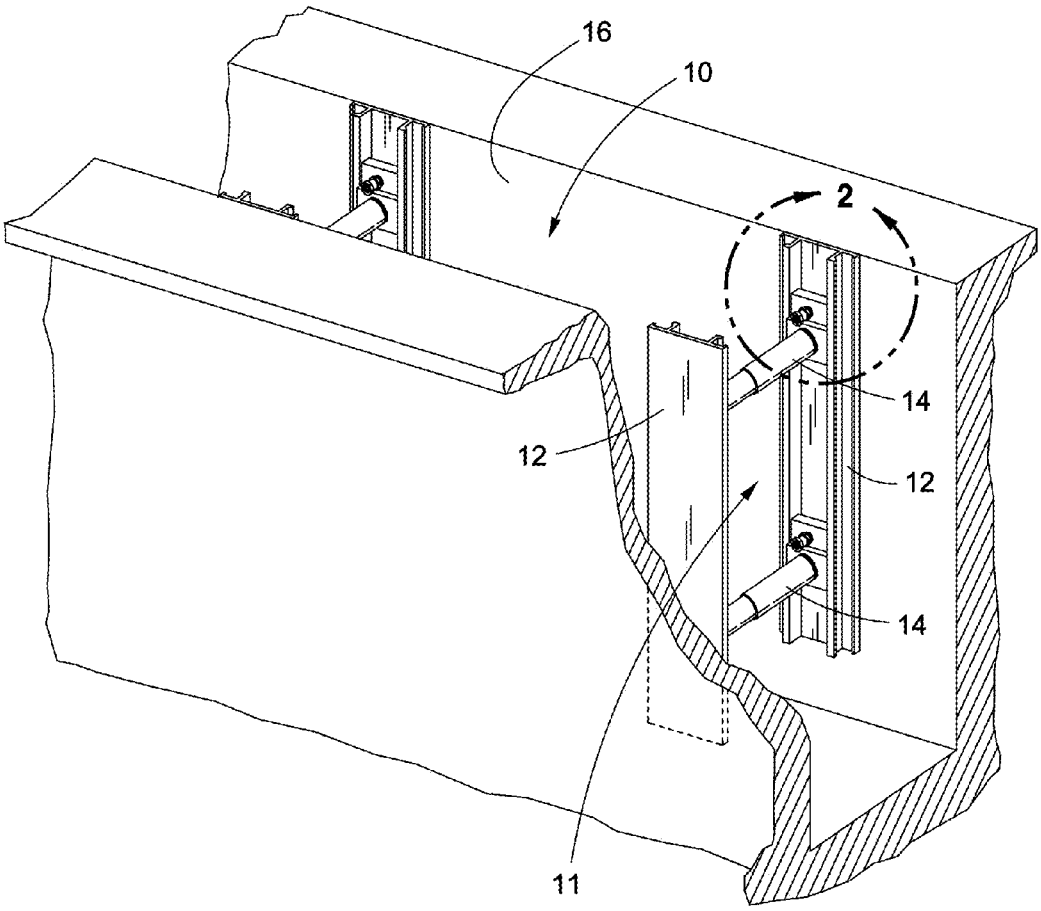
FIG. 1 is a schematic view of a trench being shored against collapse by a shoring device.
Figure 2A:
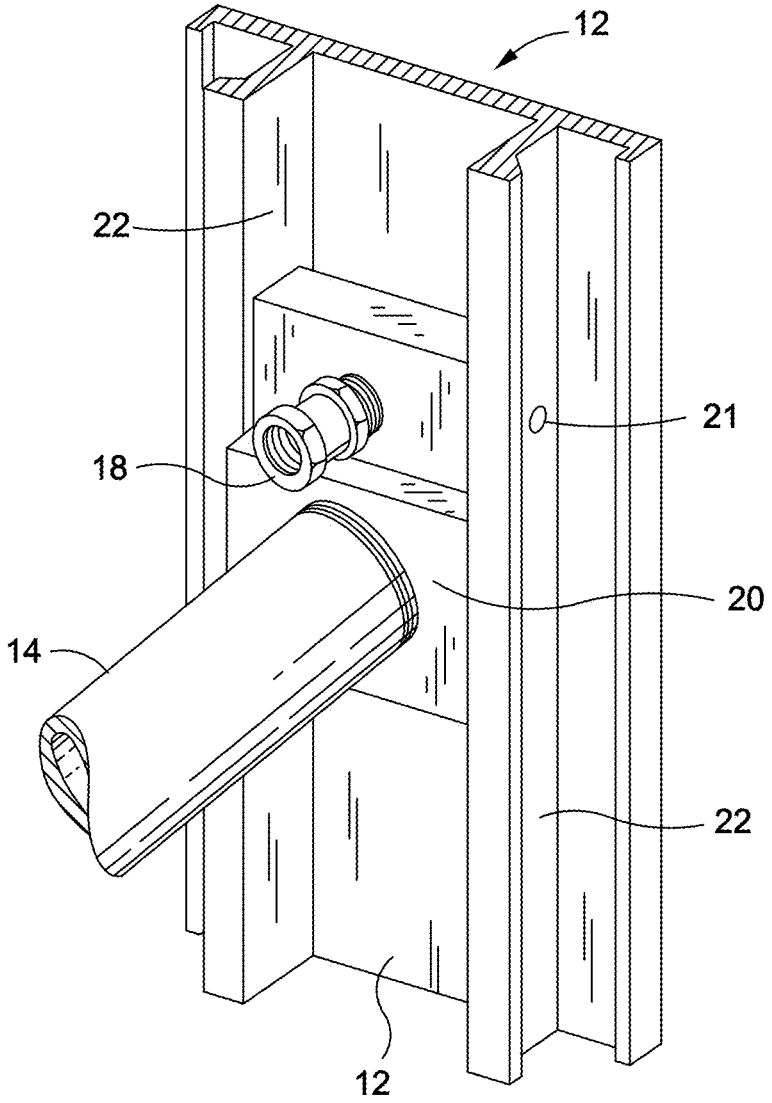
FIG. 2A is a perspective view of a detail taken from FIG. 1, as identified by the numeral 2.
Figure 2B:
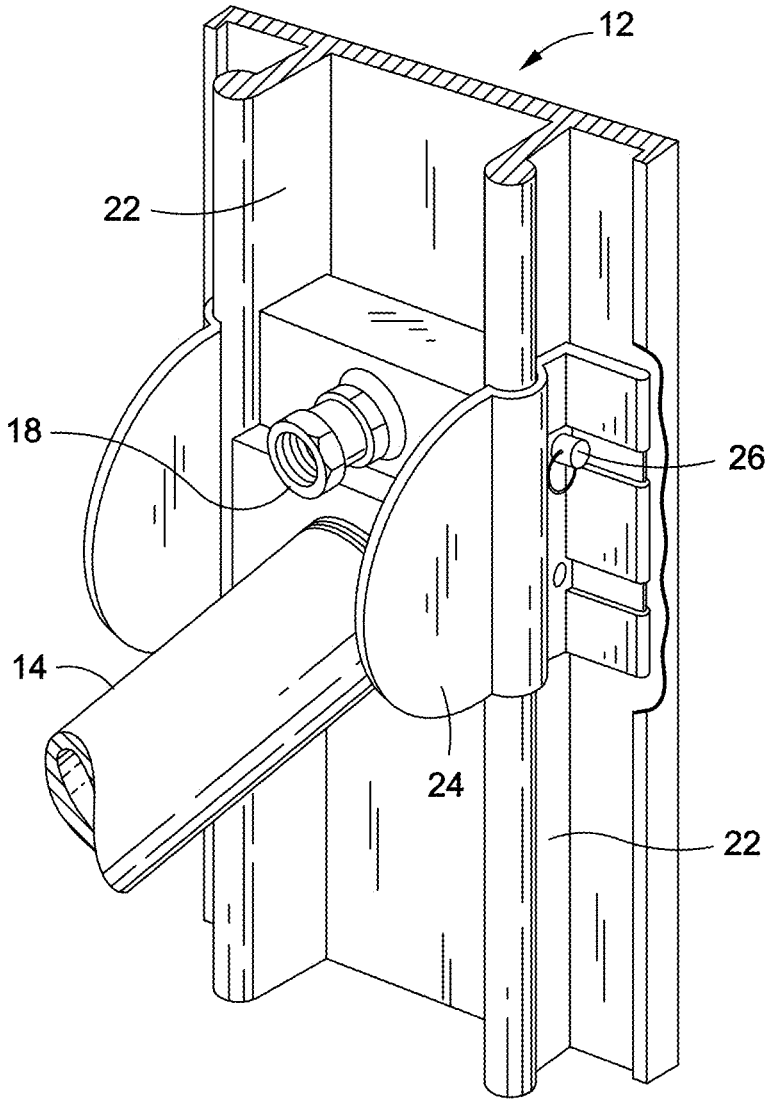
FIG. 2B (PRIOR ART)
FIG. 2B is a perspective view of a finger guard, known in the prior art, applied to the structure shown in FIG. 2A.
Figure 3:
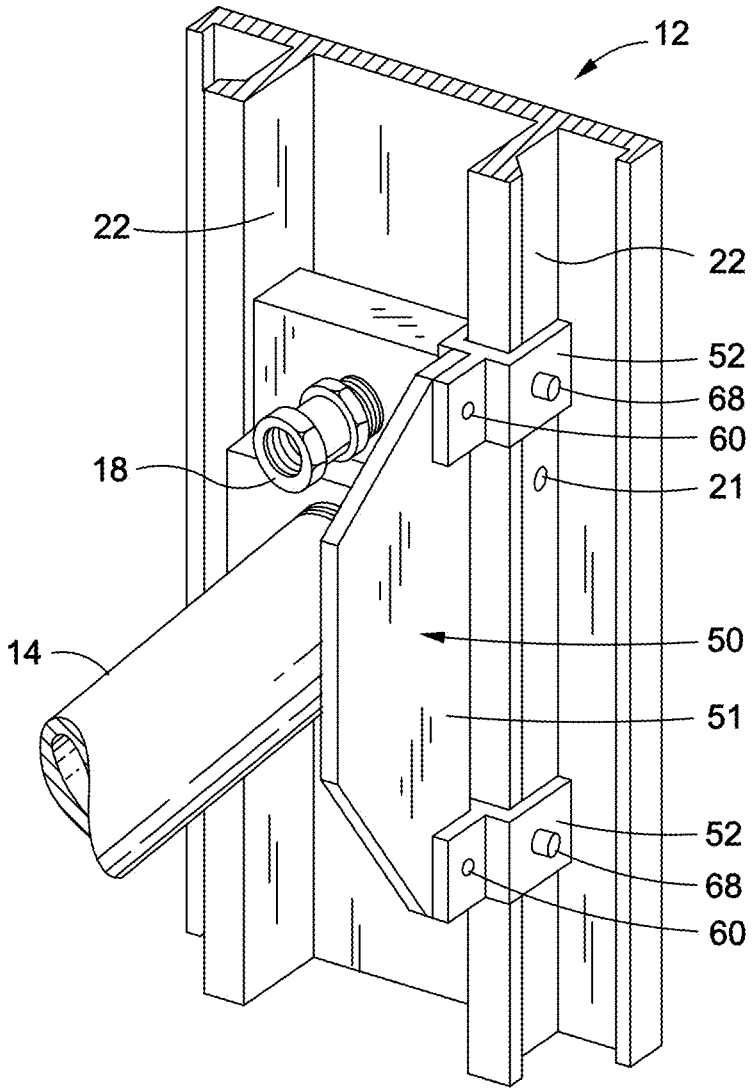
FIG. 3 is a perspective view of a finger guard having features of the invention, applied to a structure of the kind in FIG. 2A.
Figure 4:
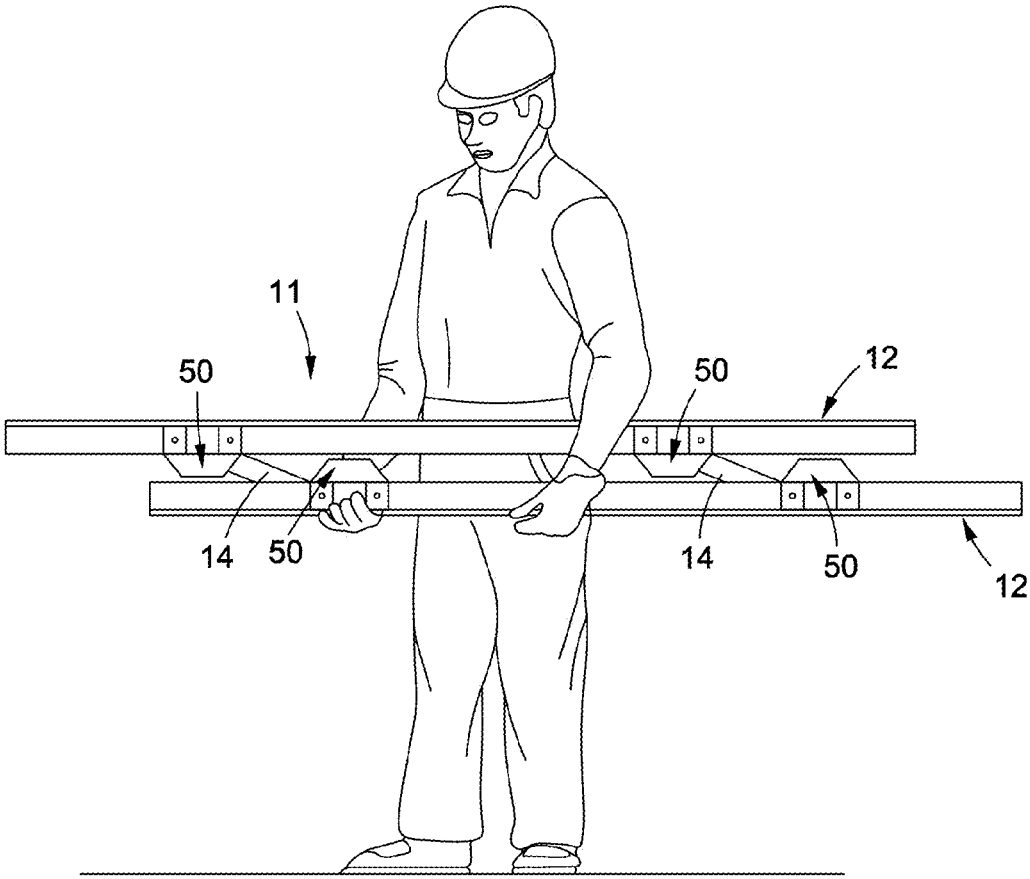
FIG. 4 is a schematic view of a folded shoring device to which the invention is attached.
Figure 6:
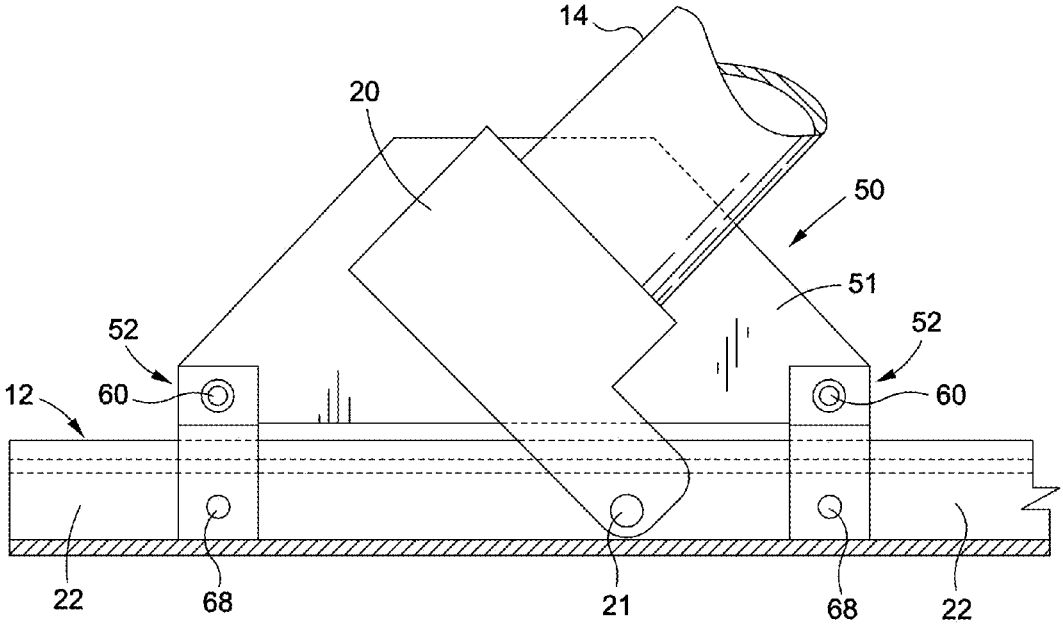
FIG. 6 is a sectional view taken through the structure seen in FIG. 5, substantially along the line marked 6-6, and to which an example of a pivoting hydraulic jack has been superimposed.
Figure 7:
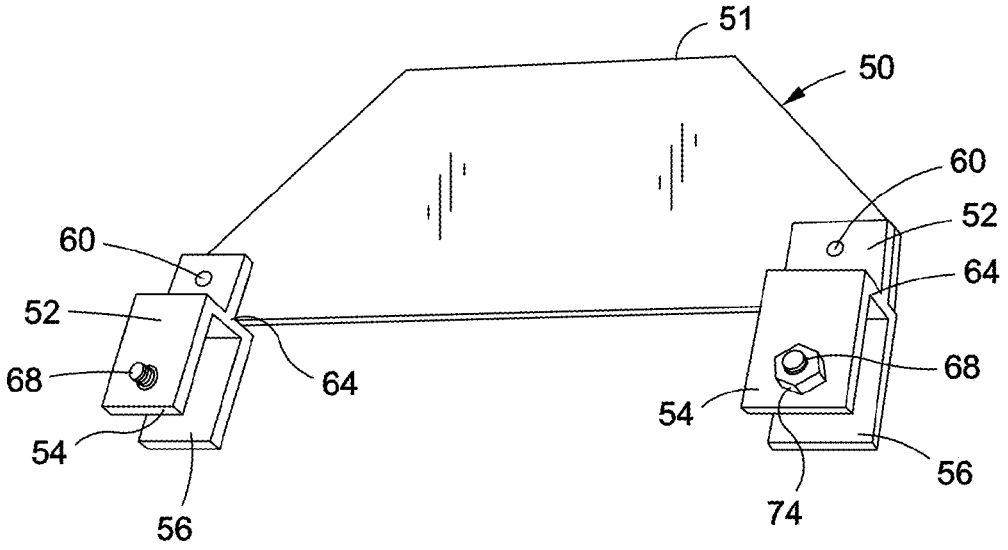
FIG. 7 is a perspective view showing structure having features of the invention.

In use, as best seen in FIGS. 4-6, at least one guard is attached to a flange 22 of a shoring column 12 at a location where an hydraulic jack 14 intersects with and is pivotably connected to the shoring column 12. In some embodiments, two finger guards may be so attached, one on either side of the hydraulic jack 14 and each to a separate flange 22 of the shoring column 12, as may be envisaged by reference to FIG. 5. The arms 54, 56 of the two connectors 52 are positioned to straddle the flange 22, and the set screw 68 of each is rotated until the set screw compresses against a flange 22 to secure the connector 52 to the flange. The connectors in turn carry the stiff sheet 51 spanning between them, so that the stiff sheet may be positioned in relation to the rotatable hydraulic jack at a suitable location chosen by the artisan to provide a safe guard against the possibility of accident. After the final position is selected, the jam nuts 74 may be tightened to avoid inadvertent loosening of the set screw.

According to an embodiment of the invention, it is possible for the artisan to alter the position of the finger guard by undoing the set screws, sliding the finger guard 50 along the flange 22, and then tightening the set screws again. This aspect gives the artisan an advantage over the prior art which is limited to positioning a finger guard at a fixed position along the shoring column due to the requirement of a matching pin hole on the shoring column. The presently described configuration also gives the artisan an advantage in that he is able to move the guard 50 from one type of shoring column to another.

The result is that when the shoring device 11 is removed from the trench 10 and folded to minimize its shape for transportation, as exemplified in FIG. 4, the finger guards 50 prevent the artisan from inadvertently inserting his hand or fingers between the jack 14 and the column 12, where they may be injured in a scissor-like entrapment.

Thus, there is described a novel and useful configuration and method for a finger guard to be used in conjunction with trench shoring equipment. Although preferred illustrative variations of the present invention are described above, it will be apparent to those skilled in the art that various changes and modifications may be made thereto without departing from the invention. It is intended in the appended claims to cover all such changes and modifications that fall within the true spirit and scope of the invention.

I claim:

1. A finger guard removably attachable to a shoring device of the type having a pair of opposed shoring columns, each column having outer and inner surfaces, the outer surfaces exposed for contact with excavation surfaces, and with an extendable and retractable jack pivotally secured at the inner surfaces to each column respectively, the finger guard comprising:

a sheet of stiff material at least one connector attached to the sheet, wherein the at least one connector includes:

two arms spaced apart from each other and extending generally parallel to each other;

a shoulder element extending between the two arms, and connecting the two arms together;

a leg element, extending from the shoulder element parallel with the arms, wherein, the sheet of stiff material is attached to the leg element;

a set screw threadably passing through one of the arms, the set screw being configured to attach the connector to a flange portion of a shoring column when rotatably advanced.

2. The safety guard of claim 1, wherein the sheet of stiff material is made from Poly Vinyl Chloride.

3. The safety guard of claim 1, wherein the at least one connector is made from aluminum.

4. The safety guard of claim 3, wherein the at least one connector is made from extruded aluminum.

5. The safety guard of claim 1, wherein the two arms are spaced apart from each other by a distance in the range of 15 mm to 25 mm.

6. The safety guard of claim 1, wherein the two arms are between 25 mm and 40 mm in length.

7. The safety guard of claim 1, wherein the at least one connector is two connectors.

8. The safety guard of claim 1, further including a jam nut threaded onto an external portion of the set screw.

9. A method for protecting an artisan's hand during soil excavation proceedings while using a shoring device of the type having a pair of opposed shoring columns having outer and inner surfaces, the outer surfaces exposed for contact with excavation surfaces and with an extendable and retractable jack pivotally secured at the inner surfaces of each column respectively, wherein the inner surface includes at least one flange, the method comprising:

attaching two connectors to a stiff sheet of material, each connector having a forked configuration with two parallel arms that are set apart from each other;

positioning each arm on either side of the flange;

attaching the connectors to the flange by advancing a rotatable set screw inserted through an arm of each connector respectively.

10. The method of claim 9, further including retracting the rotatable set screw, followed by adjusting the position of the connectors on the flange, followed by re-attaching the connectors to the flange by advancing the set screw.

* * * * *